United States Patent [19]

Geisthardt

[11] Patent Number: 4,509,291

[45] Date of Patent: Apr. 9, 1985

[54] HORIZONTALLY SLIDING DOOR

[75] Inventor: Alan C. Geisthardt, North Fond du Lac, Wis.

[73] Assignee: Jack Walters & Sons Corp., Allenton, Wis.

[21] Appl. No.: 507,297

[22] Filed: Jun. 24, 1983

[51] Int. Cl.[3] ..... E05D 13/02

[52] U.S. Cl. ..... 49/409; 49/501

[58] Field of Search ..... 49/409–412, 49/501; 52/656

[56] References Cited

U.S. PATENT DOCUMENTS

| | | | |
|---|---|---|---|
| 941,069 | 11/1909 | Frame et al. | 49/409 X |
| 3,189,141 | 6/1965 | Dusing et al. | 49/412 X |
| 3,802,393 | 4/1974 | Naylor | 49/409 X |
| 3,845,601 | 11/1974 | Kostecky . | |
| 4,021,988 | 5/1977 | Edeus et al. . | |
| 4,033,086 | 7/1977 | Marchot | 52/656 |
| 4,081,880 | 4/1978 | Edeus . | |
| 4,193,245 | 3/1980 | Johnson | 52/656 |

*Primary Examiner*—Kenneth Downey

*Attorney, Agent, or Firm*—Andrus, Sceales, Starke & Sawall

[57] ABSTRACT

A sliding door is constructed with a rectangular metal framework of C-frame channel rail sections joined at their corners. A plurality of vertically spaced horizontal reinforcing struts join the frame side rails. The top rail of the door is slidingly hung from a track by hangers including hanger brackets. The bottom frame rail is held in position by a guide track. A thin siding panel and other structure is secured to the front flanges of the framework. Twisting of the top rail, caused by the forwardly offset weight of the front mounted structure including the siding panel, is prevented by braces connected between the top rail rear flange immediately adjacent the hanger brackets and the rear flange of the next lowermost horizontal strut. Wind-caused twisting of the bottom rail and resultant disengagement from its guide track is prevented by braces connected between the rear flanges of the bottom rail and the next uppermost horizontal strut.

6 Claims, 9 Drawing Figures

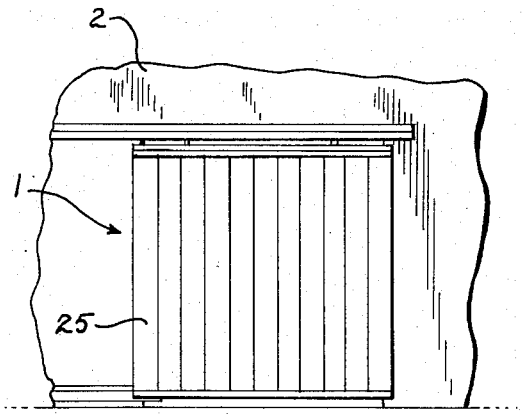
FIG. 1
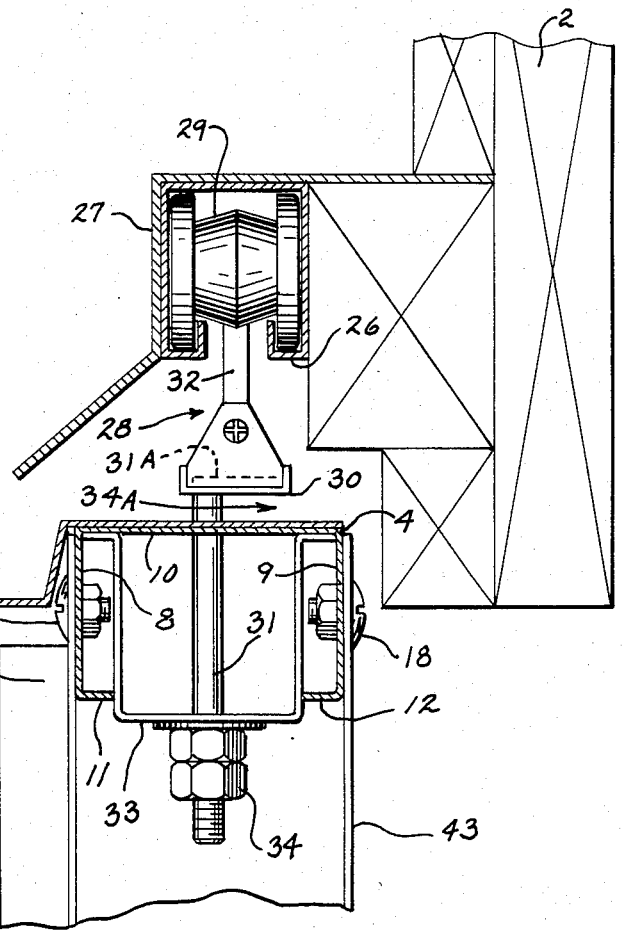
FIG. 3
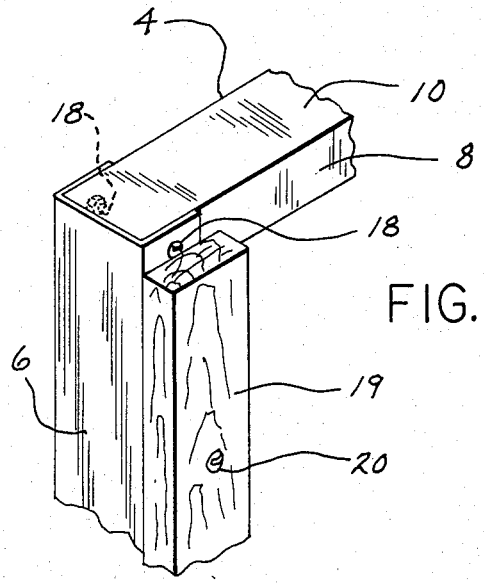
FIG. 4
FIG. 5
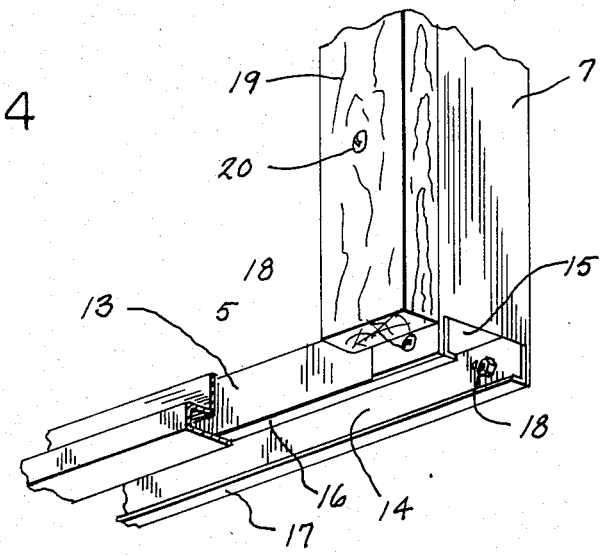

HORIZONTALLY SLIDING DOOR

| U.S. Prior Art of Interest | | |
|---|---|---|
| U.S. Pat. No. | Inventor | Issue Date |
| 3,845,601 | Kostecky | Nov. 5, 1974 |
| 4,021,988 | Edeus et al | May 10, 1977 |
| 4,081,880 | Edeus | Apr. 4, 1978 |
| 4,193,245 | Johnson | Mar. 18, 1980 |

BACKGROUND AND SUMMARY OF THE INVENTION

This invention relates to a horizontally sliding door and more particularly to a door assembly which is hung for sliding along an upper track and which is held in position at the bottom by a horizontal guide rail.

Previous sliding doors have been constructed of a rectangular metal framework of C-frame channel rail sections which are suitably secured together at the corners, and which is often provided with several vertically spaced horizontal reinforcing struts extending between the side rails. A thin siding panel, usually of metal, is suitably secured to the front flanges of the frame channel sections but is usually not secured to the horizontal struts.

Such sliding doors have usually been slidingly suspended from a track mounted to the building above the door opening by means of a plurality of spaced hangers which are fixedly attached to the top frame rail by hanger brackets. The bottom frame rail is held in position by a guide track mounted on each side of the lower portion of the door opening.

It has been observed that the top and bottom rails of some door frames have tended to become distorted in use, so that the door loses its ability to slide freely. For example, the top frame rail has sometimes tended to twist about its longitudinal axis so that it drops from its guide rail. Furthermore, the bottom frame rail has also been found to twist about its longitudinal axis and come off its guide track. Up to now, the cause of these malfunctions has not been determined.

The present invention is based on a discovery of the reasons for the undesirable twisting of the door frame rails, and a solution to the problem.

It is to be remembered that the siding panel for the door is mounted to the vertical front flanges of the C-frame channel sections, including the top rail. It has been discovered that the weight of this siding panel, as well as other structure, exerts a strong downward force component on the front flange of the top rail. In the area of the top rail between the vertical side rails, the top rail front flange is pulled downwardly by the siding panel weight, thus causing the rail to twist about its hangers and its rear flange to thereupon pivot upwardly, thus destroying the hanger alignment.

As to the bottom frame rail, if the door is left partially open, wind sometimes blows through the door opening, thus penetrating behind the door. It has been discovered that the wind can then exert a forward force on the rear flange of the lower frame rail, causing the rail to twistingly rise upwardly and come off its guide track.

The concepts of the present invention take these discoveries into account and provides a simple yet effective solution to the aforementioned difficulties.

In accordance with the various aspects of the invention, the rear flange of the top frame rail immediately adjacent each hanger bracket is fixedly connected to the upper end of a brace which extends downwardly into fixed connection with the rear flange of the next lowermost horizontal frame strut. By joining the intermediate portions of the rear flanges of the top rail and the next lowermost frame strut, the upwardly directed forces on the top rail rear flange caused by the offset weight on its front flange is carried to the rear flange of the next lowermost strut so that the load is shared and the top rail doesn't twist at its hangers.

As to the bottom frame rail, a plurality of similar braces are fixedly connected between the rear flanges of the bottom rail and the next uppermost horizontal strut so that the load due to wind is similarly shared and the rear flange of the bottom rail doesn't come off the lower guide track.

BRIEF DESCRIPTION OF THE DRAWINGS

The accompanying drawings illustrate the best mode presently contemplated by the inventor for carrying out the invention.

In the drawings:

FIG. 1 is a front perspective view of a horizontally sliding door mounted to a building;

FIG. 3 is a vertical section taken on line 3—3 of FIG. 2;

FIG. 4 is a fragmentary detail perspective view of the left top frame corner of FIG. 2, the right top corner being a reverse image;

FIG. 5 is a fragmentary detail perspective view of the right bottom frame corner of FIG. 2, the left bottom corner being a reverse image;

DESCRIPTION OF THE PREFERRED EMBODIMENT

Figure 2:
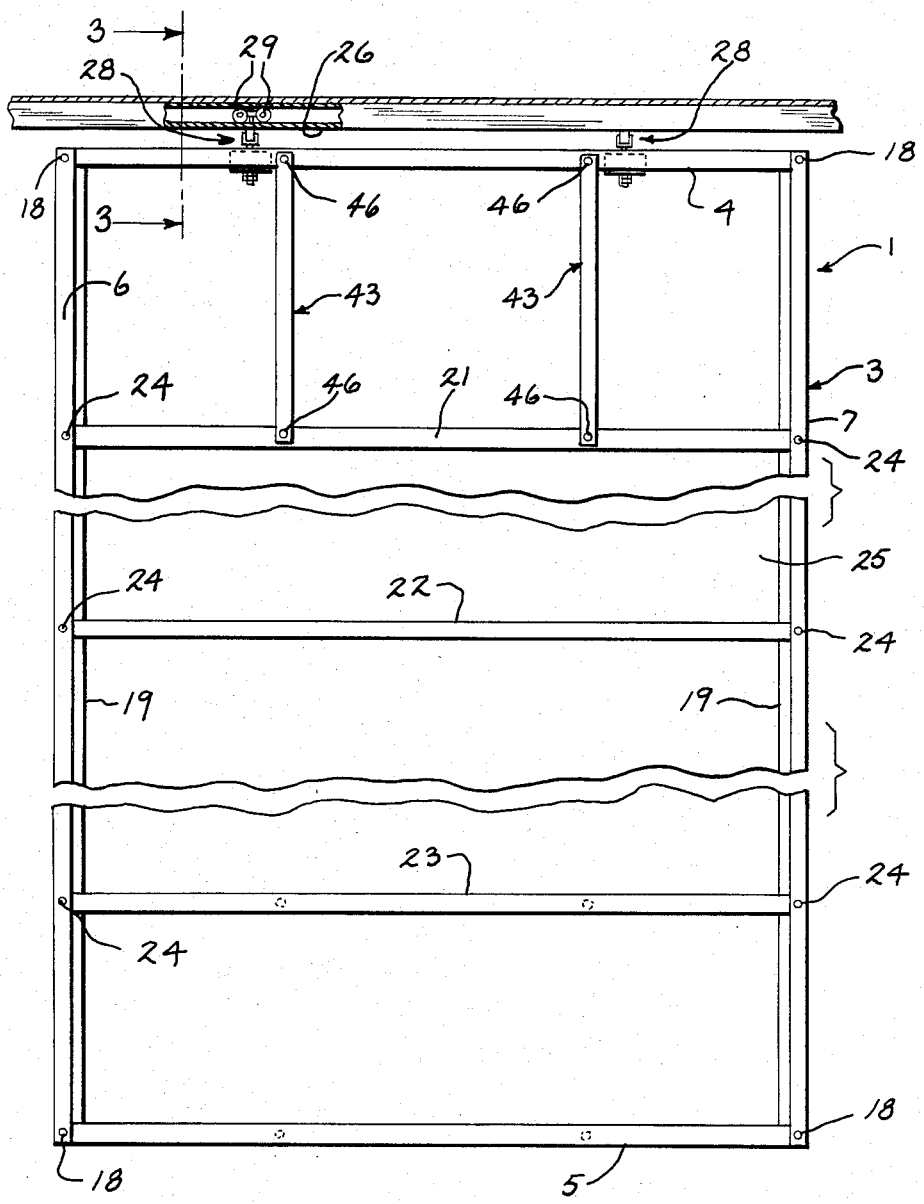
FIG. 2 is a rear elevation of the door with upper braces and with parts removed and broken away.

As shown in the drawings, the concepts of the invention are adapted for use with a horizontally sliding door 1 which is mounted to a building wall 2 for covering a door opening, not shown.

Referring especially to FIGS. 2, 4 and 5, door 1 includes a rectangular frame 3, preferably of metal, which comprises a plurality of C-frame channel rails designated as the top rail 4, bottom rail 5, and side rails 6 and 7 respectively, with said rails being open. Top rail 4 includes front and rear flanges 8 and 9 respectively joined by a web 10. Flanges 8 and 9 are also provided with inwardly extending lips 11 and 12 on their respective outer edges. Bottom rail 5 likewise includes front and rear flanges 13 and 14, web 15 and respective lips 16 and 17. Side rails 6 and 7 are similarly constructed. The ends of rails 4–7 are joined in any suitable manner, as by bolts and whiz nuts 18. Suitable strengthening 2×4's 19 are secured to the front flanges of side rails 6 and 7, as by bolts or the like 20.

Frame 3 further includes a plurality of vertically spaced horizontal struts 21, 22, 23 which are secured at their ends to side rails 6 and 7, as by further bolts or the like 24 which also pass through 2×4's 19.

Door 1 is completed by a siding panel 25 which is mounted to the front side of the peripheral portion of frame 3, and held in place by similar whiz nuts 18 and bolts 20, 24, or the like on all four sides.

For purposes of hanging door 1 from building wall 2, and as best shown in FIGS. 2 and 3, an elongated track 26 is mounted above door 1 and may be hidden by suitable flashing 27. A trolley 28 is adapted to slidingly suspend door 1 from track 26 and includes suitable wheels 29 disposed to ride on the track, together with a hanger 30 which is suspended therebelow. Hanger 30 provides a slotted nesting member for a releasable hanger plate 31A which is secured to the upper end of a rod 31. Rod 31 extends downwardly through flange 10 of rail 4. Note that rod 31 is offset forwardly from the upper central portion 32. Rod 31 is attached at its lower end to a hanger bracket 33 which fits within channel rail 4 and is tightened upwardly onto web 10 as by nuts 34 threaded onto rod 31. However, nuts 34 are not threaded so far onto rod 31 as to cause hanger bracket 33 and rail 4 to engage hanger 30. This leaves a space 34A, which provides a leeway for adjustably leveling the door.

As shown in FIG. 2, there are two horizontally spaced trolley-hanger assemblies for door 1, providing a two-point hanging support therefor.

Figure 8:
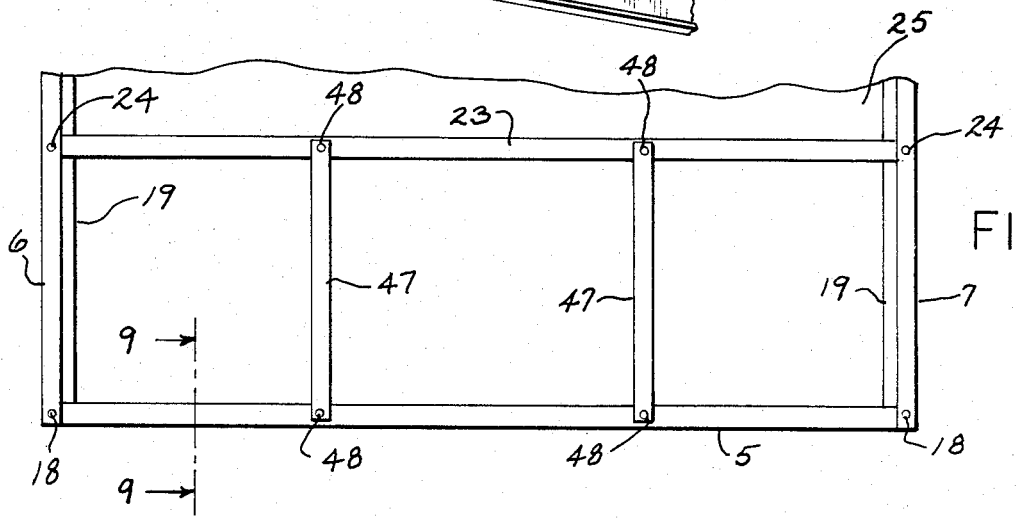
FIG. 8 is a fragmentary rear elevation of the door with lower bracing.
Figure 9:
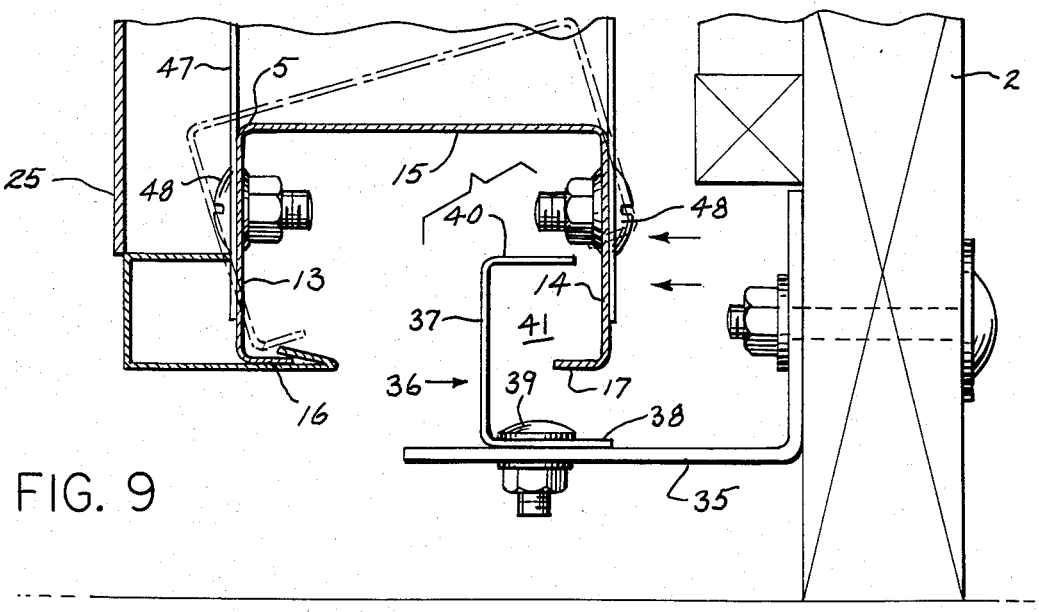
FIG. 9 is a vertical section taken on line 9—9 of FIG. 8.

For purposes of guiding and holding the lower edge portion of door 1 in place, and as best shown in FIGS. 8 and 9, an elongated L-shaped bracket 35 is mounted to the front of building wall 2 and serves as a platform support for retainer or guide member 36. Member 36 is provided with a vertical upwardly extending web 37 having a lower flange 38 secured to bracket 35 as by a whiz nut 39, and an upper flange 40. Web 37 is spaced outwardly from wall 2, while upper flange 40 extends toward the wall, but is spaced therefrom to form a guide channel 41 which releasably receives flange 17 of bottom rail 5 beneath the flange 40. This prevents outward swinging of the bottom of door 1.

Figure 6:
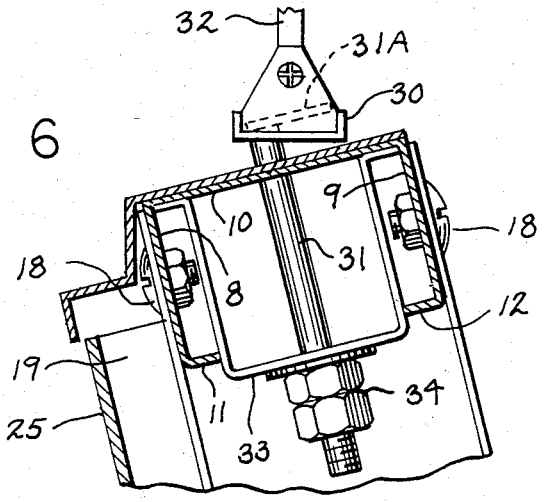
FIG. 6 schematically illustrates the undesirable twisting of the top frame rail.

Turning now to FIG. 6, it has been observed that top rail 4 tends to twist about its axis, which may cause the door to drop from its tracks. The cause of this undesirable action has been discovered to be that the extra and forwardly offset weight on the front face of door 1, forwardly of trolley 28 and the central plane of the door, caused in this instance by the siding panel element 25 and 2×4's 19, exerts a downward force on flange 8 which causes rail 4 to twist and thereby pivot about a point containing hanger rod 31 of trolley 28, forcing rear flange 9 upwardly. Refer to FIGS. 6 and 3. This, in turn, causes rod 31 to rise upwardly and angularly so that hanger plate 31A is released from nesting engagement with hanger 30. Door 1 will then fall from its support.

Figure 7:
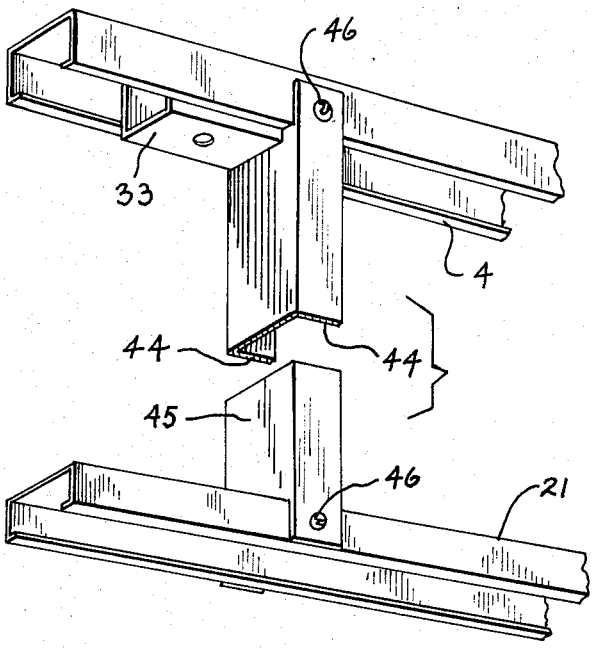
FIG. 7 is a fragmentary perspective view showing the upper braces.

To solve this problem, means are provided to prevent top rail 4 from twisting by holding flanges 8 and 9 against vertical movement. In the embodiment shown in FIGS. 2 and 3, a generally upright vertical brace 43 extends from immediately adjacent each hanger bracket 33 of each trolley 28 and downwardly where it terminates at the next lowermost horizontal strut 21. As shown in FIG. 7, each brace comprises a channel member having side flanges 44 joined by a web 45. Both ends of each web 45 are cut away so that the flange ends fit over the respective top rail 4, flanges 8 and 9 and over strut 21, with suitable bolts and whiz nuts 46 fixedly and rigidly joining the members.

By rigidly connecting rail 4 with strut 21, any components of twist in the vicinity of trolleys 28 which tend to pull front flange 8 down and raise rear flange 9 will be transferred to strut 21, thus eliminating the twist and preventing door 1 from falling off its carrier.

Referring now to FIG. 9 which illustrates the lower portion of door 1, it has been observed that bottom rail 5 sometimes tends to twist about its axis so that its rear flange rises, carrying lip 14 upwardly past flange 40 of guide member 36, as shown in phantom. It has been discovered that the cause of such twisting is wind, represented by arrows in FIG. 9, which gets behind the door when it is partially open. To solve this problem, means are provided to prevent bottom rails 5 from twisting, by holding its flanges against vertical movement. For this purpose, and as shown in FIGS. 8 and 9, a pair of spaced upright vertical braces 47 extend from rail 5 and upwardly where they terminate at the next uppermost strut 23. Braces 47 are constructed and connected similar to braces 43, with suitable whiz nuts 48 joining their flanges.

By rigidly connecting rail 5 with strut 23, any components of twist in rail 5 will be transferred upwardly to strut 23, thus eliminating the twist and preventing the bottom of door 1 from coming out of its lower track.

Various modes of carrying out the invention are contemplated as being within the scope of the following claims particularly pointing out and distinctly claiming the subject matter which is regarded as the invention.

I claim:

1. A horizontally sliding door adapted for two point hanging support on a building from a pair of horizontally spaced track-mounted trolleys from which releasable hanger brackets are suspended, said door comprising:

(a) a rectangular peripheral frame including elongated top, bottom and side rails of generally channel shape and with said rails being open and having spaced front and rear flanges joined by a web, (b) the flanges of said top rail extending downwardly, and the web of said top rail receiving said hanger brackets thereon for connecting said top rail to said trolleys, (c) a plurality of vertically spaced horizontal struts joined to and extending between said side rails, (d) a siding panel mounted to the front flanges of said rails of said peripheral frame and with said panel providing a weight component offset forwardly of the central plane of the door, (e) said siding panel offset weight component forming means creating a twist component in said open top rail tending to pivotally pull said top rail front flange vertically downwardly with resultant vertical rising of said top rail rear flange at said hanger brackets so that said hanger brackets tend to release from said trolley, (f) and means disposed immediately adjacent said hanger brackets to hold said open top rail in place against said twisting component.

2. The door of claim 1:

(a) wherein said holding means comprises a brace disposed adjacent each said hanger bracket and extending from said top rail downwardly and terminating at the uppermost strut of said plurality of struts, (b) and means fixedly mounting the ends of each said brace to said open top rail and uppermost strut.

3. The door of claim 2 wherein each said brace is attached by said mounting means to both said front and rear flanges of said open top rail so that said twist component is transferred to said uppermost strut.

4. The door of claim 3:

(a) which includes an inwardly extending lip disposed on said rear flange of said open bottom rail and with said lip adapted to be releasably disposed in a guide channel formed by a retainer attached to the building, (b) said bottom rail being subject to wind forces tending to twist said bottom rail so that said lip is released from the guide channel and retainer, (c) and means to hold said open bottom rail in place against twisting.

5. The door of claim 4:

(a) wherein said last-named holding means comprises a pair of braces extending from said bottom rail upwardly and terminating at the lowermost strut of said plurality of struts, (b) and means fixedly mounting the ends of each said last-named brace to said open bottom rail and lowermost strut.

6. The door of claim 5 wherein each said last-named brace is attached by said last-named mounting means to both said front and rear flanges of said open bottom rail.

* * * * *